US011458442B2

(12) United States Patent
Sekimoto et al.

(10) Patent No.: US 11,458,442 B2
(45) Date of Patent: Oct. 4, 2022

(54) ULTRASONIC HOMOGENIZER

(71) Applicant: Kaijo Corporation, Hamura (JP)

(72) Inventors: Mineyuki Sekimoto, Ishikawa (JP); Hitoshi Yamamoto, Ishikawa (JP); Hiroshi Hasegawa, Saitama (JP); Takashi Kawamura, Tokyo (JP)

(73) Assignee: KAIJO CORPORATION, Tokyo (JP)

( * ) Notice: Subject to any disclaimer, the term of this patent is extended or adjusted under 35 U.S.C. 154(b) by 28 days.

(21) Appl. No.: 16/953,334

(22) Filed: Nov. 20, 2020

(65) Prior Publication Data

US 2021/0154630 A1 May 27, 2021

(30) Foreign Application Priority Data

Nov. 27, 2019 (JP) ..... JP2019-214384
Aug. 4, 2020 (JP) ..... JP2020-132667

(51) Int. Cl.
*B01F 31/80* (2022.01)
*B01F 35/92* (2022.01)
*B01F 35/90* (2022.01)

(52) U.S. Cl.
CPC ..... *B01F 31/841* (2022.01); *B01F 35/92* (2022.01); *B01F 2035/98* (2022.01)

(58) Field of Classification Search
CPC .... B01F 31/841; B01F 35/92; B01F 2035/98; B01F 25/305
USPC ..... 366/110
See application file for complete search history.

(56) References Cited

U.S. PATENT DOCUMENTS 6,155,710 A * 12/2000 Nakajima ..... B01F 25/3142 366/167.1
2012/0152723 A1* 6/2012 Yoneya ..... B01F 25/10 422/128

FOREIGN PATENT DOCUMENTS

JP 54-033018 Y2 5/1976
JP 3549211 B2 7/1993
JP 2011-017886 1/2011

* cited by examiner

*Primary Examiner* — Marc C Howell
(74) *Attorney, Agent, or Firm* — Mori & Ward, LLP

(57) ABSTRACT

An ultrasonic homogenizer includes an ultrasonic transducer; an ultrasonic horn that irradiates an ultrasonic wave generated by the ultrasonic transducer; a holder that receives an irradiating surface of the ultrasonic horn; an intake port that is provided on a bottom face of the holder and intakes a mixture liquid into the holder; and an ejection port that is provided on the holder above the intake port and discharges the mixture liquid supplied inside the holder; an opening area of the intake port being smaller than an irradiating area of the ultrasonic horn and the irradiating surface of the ultrasonic horn being disposed above the intake port whereby facing the intake port.

8 Claims, 4 Drawing Sheets

ULTRASONIC HOMOGENIZER

BACKGROUND OF THE INVENTION

1. Field of the Invention

The present invention relates to an ultrasonic homogenizer that irradiates ultrasonic waves for dispersion.

2. Description of the Related Art

An ultrasonic homogenizer includes an ultrasonic horn disposed in liquid which vibrate at a frequency in the ultrasonic region so that substances, such as powder, are dispersed in the liquid by cavitation generated by ultrasonic waves that are irradiated into the liquid from the vibrating surface (irradiation surface). For example, in Japanese Unexamined Patent Application Publication No. 2011-017886, an ultrasonic horn is provided inside a vertical cylindrical container along the axis of the container to vibrate in the axial direction while a liquid mixture is supplied from an upper portion of the side surface of the cylindrical container, and the mixture liquid is discharged from a lower portion of the side surface. Furthermore, ring-shaped vibrating surfaces (irradiation surfaces) of the ultrasonic horn are provided in parallel along the axial direction of the transducer whereby cavitation is effectively generated within gaps between the vibrating surfaces to create zones where ultrasonic waves are irradiated.

SUMMARY OF THE INVENTION

According to the configuration of Patent Document 1, ultrasonic cavitation can be effectively generated in the mixture liquid (liquid mixture) between the vibrating surfaces. However, most of the mixture liquid flows close to and along the inner peripheral surface so that the mixture liquid flows outside of the ultrasonic wave irradiation zones, which are provided between the vibrating surfaces. Therefore, most of the mixture liquid is discharged from the homogenizer without being subjected to the ultrasonic cavitation, so that a sufficient dispersion effect cannot be obtained.

One aspect of the present invention is to effectively generate the ultrasonic cavitation in the mixture liquid, which flows inside the ultrasonic homogenizer, and to improve the dispersion performance of the ultrasonic homogenizer.

An ultrasonic homogenizer according to a primary aspect of the present invention includes an ultrasonic transducer; an ultrasonic horn that irradiates an ultrasonic wave generated by the ultrasonic transducer; a holder that receives an irradiating surface of the ultrasonic horn; an intake port that is provided on a bottom face of the holder and intakes a mixture liquid into the holder; and an ejection port that is provided on the holder above the intake port and discharges the mixture liquid supplied inside the holder; an opening area of the intake port being smaller than an irradiating area of the ultrasonic horn and the irradiating surface of the ultrasonic horn being disposed above the intake port whereby to face the intake port.

BRIEF DESCRIPTION OF THE DRAWINGS

The objects and advantages of the present invention will be better understood from the following description with references to the accompanying drawings in which.

DESCRIPTION OF THE PREFERRED EMBODIMENTS

Figure 1:
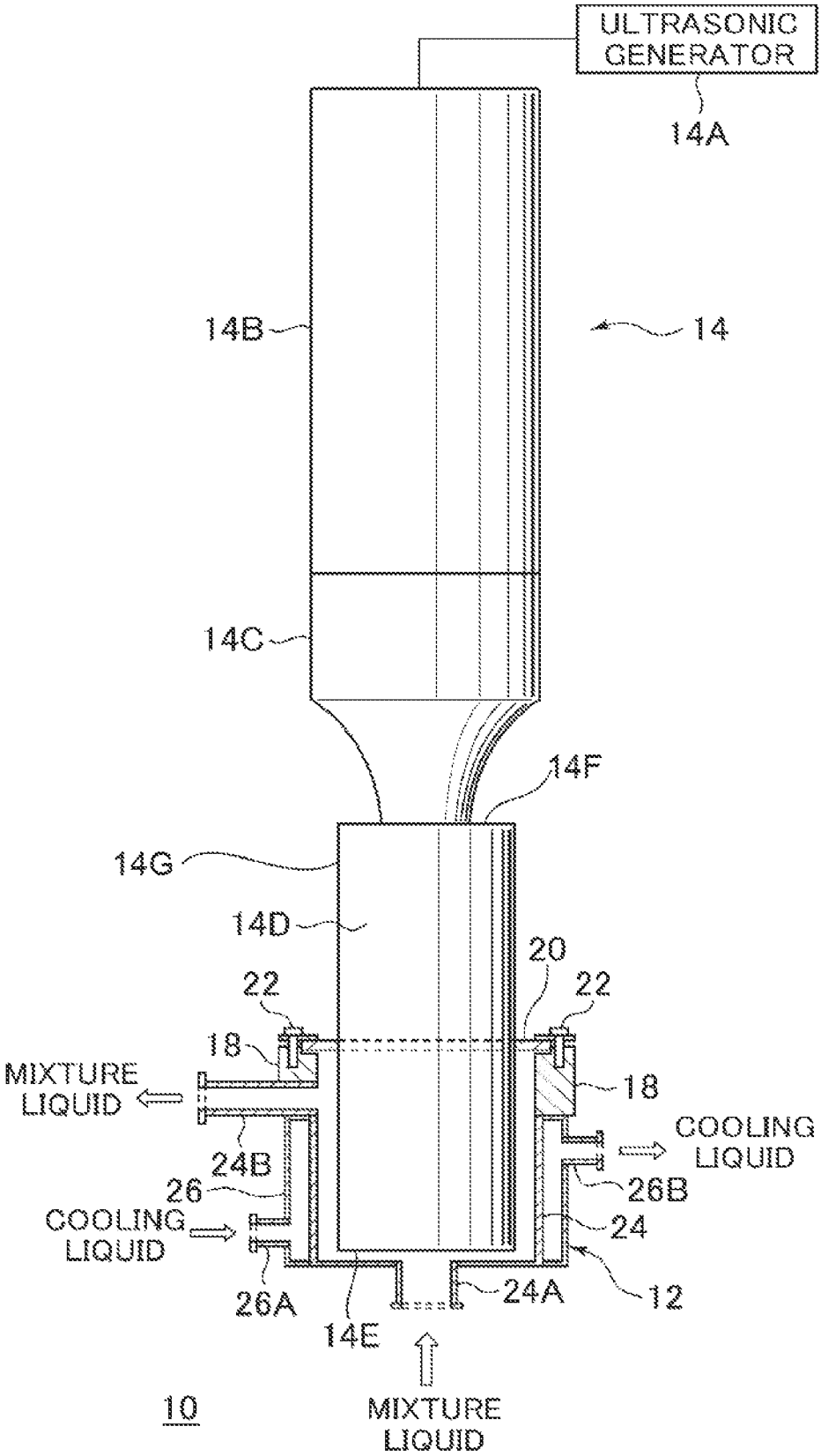
FIG. 1 is a cross-sectional side view of an ultrasonic homogenizer according to an embodiment of the present invention.
Figure 2:
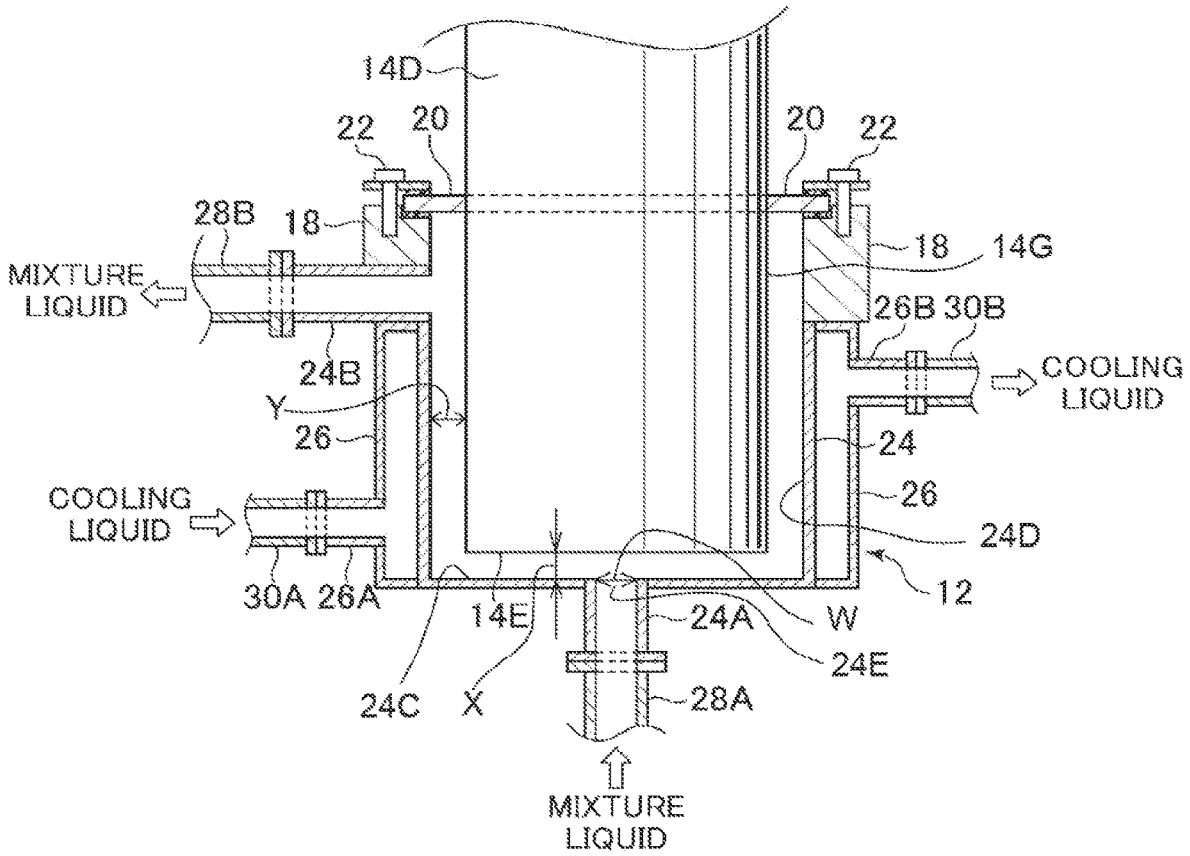
FIG. 2 is an enlarged cross-sectional side view of the ultrasonic homogenizer about a holder.

The present invention is described below with references to the embodiments shown in the drawings. FIG. 1 is a cross-sectional side view of an ultrasonic homogenizer, which is an embodiment of the present invention. FIG. 2 is an enlarged cross-sectional side view of the ultrasonic homogenizer 10 about a holder 12.

The ultrasonic homogenizer 10 of the present embodiment includes the holder 12, where a mixture liquid of various kinds of substances, such as liquid and powder, liquid and liquid, etc., is injected and an ultrasonic generating device 14, which generates ultrasonic waves of a predetermined frequency, intensity and waveform.

The ultrasonic generation device 14 includes an ultrasonic generator 14A, an ultrasonic transducer 14B, a booster 14C and an ultrasonic horn 14D. The ultrasonic generator 14A generates drive signals corresponding to a predetermined setup frequency, intensity and waveform and transmits them to the ultrasonic transducer 14B. The ultrasonic transducer 14B vibrates according to the drive signals from the ultrasonic generator 14A and an amplitude of the ultrasonic vibration generated by the ultrasonic transducer 14B is amplified via the booster 14C and transmitted to the ultrasonic horn 14D. Thereby, the ultrasonic horn 14D is vibrated in a vertical direction along its axis at the predetermined frequency, intensity and waveform. The ultrasonic horn 14D, for example, has a cylindrical shape and its bottom end is inserted into the holder 12 with its axis arranged vertically.

The ultrasonic horn 14D has a top face 14F, a bottom face 14E opposite to the top face 14F, and an outer side face 14G provided between and connected to the top face 14F and the bottom face 14E. The top face 14F is connected to the ultrasonic transducer 14B. The bottom face 14E is configured to irradiate an ultrasonic wave generated by the ultrasonic transducer 14B. The center of vibration of the ultrasonic horn 14D is held by a flange member 20 attached to the upper opening edge 18 of the holder 12, whereby the ultrasonic horn 14D is fixed in a predetermined position with respect to the holder 12. The flange member 20 may be attached to the upper opening edge 18 of the holder 12 by fasteners such as bolts 22.

At the center of the holder 12, there is provided a mixing vessel 24 in which the ultrasonic horn 14D is inserted and the mixture liquid is supplied. Around the mixing vessel 24, a cooling vessel (or jacket) 26 in which a cooling liquid (cooling medium) is circulated is provided surrounding the outer periphery of the mixing vessel 24. The mixing vessel 24 has a cylindrical shape and is opened to the outside through the upper opening edge 18.

An inlet portion (an intake port) 24A is provided at the center of the bottom face of the mixing vessel 24 through which a mixture liquid supply tube 28A is connected. An outlet portion (ejection port) 24B is provided at an upper peripheral portion of the mixing vessel 24, through which a mixture liquid ejection tube 28B is connected. Namely, the mixture liquid flows into the mixing vessel 24 through the center of the bottom and is ejected from the upper peripheral portion. The mixing vessel 24 has an inner bottom face 24C and an inner side face 24D connected to the inner bottom face 24C. The ultrasonic horn 14D is provided in the holder 12 such that the bottom face 14E of the ultrasonic horn 14D faces the inner bottom face 24C of the mixing vessel 24 and such that the inner side face 24D of the mixing vessel 24 surrounds and faces the outer side face 14G of the ultrasonic horn 14D.

An inlet portion 26A is provided at a lower peripheral portion of the cooling vessel 26 through which a cooling liquid supply tube 30A is connected. Furthermore, at an upper peripheral portion of the cooling vessel 26, for example, at the opposite side of the inlet portion 26A with respect to the mixing vessel 24, an outlet portion (an ejection port) 26B is provided, through which a cooling liquid ejection tube 30B is connected. The cooling liquid suppresses rising temperatures of the mixture liquid inside the holder 12, which are caused by the ultrasonic vibration.

As illustrated in FIG. 2, a bottom face 14E of the cylindrical ultrasonic horn 14D, which is a vibrating surface (an irradiation surface), is disposed above the inlet portion (the intake port) 24A and faces the inlet portion 24A at a predetermined distance from the bottom face of the mixing vessel 24, whereby a flow passage having a predetermined gap between the mixing vessel 24 and the bottom face 14E of the ultrasonic horn 14D is provided.

Figure 3:
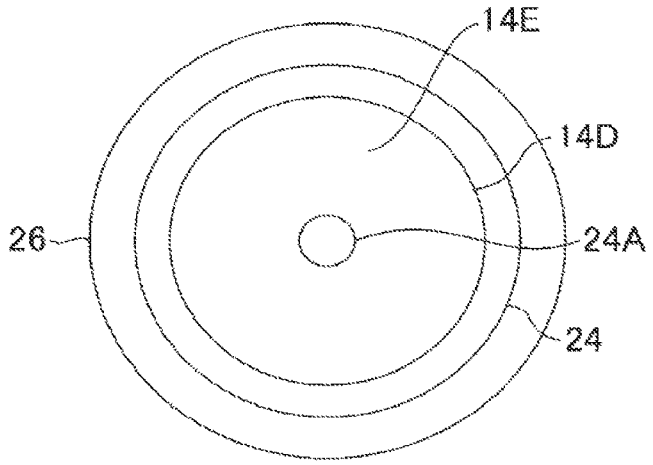
FIG. 3 is a plan view illustrating an arrangement of the ultrasonic horn and the holder in the radial direction.

FIG. 3 is a plan view illustrating an arrangement of the ultrasonic horn 14D and the holder 12 in the radial direction. The geometrical arrangement of an inner surface of the inlet portion 24A of the mixing vessel 24, an outer surface of the ultrasonic horn 14D, an outer sidewall of the mixing vessel 24, and an outer sidewall of the cooling vessel 26 are illustrated. As illustrated in FIG. 3, in the present embodiment, an inner surface of the inlet portion 24A of the mixing vessel 24, an outer surface of the ultrasonic horn 14D, an outer sidewall of the mixing vessel 24, and an outer sidewall of the cooling vessel 26 are approximately concentrically arranged. Thereby, a flow passage having a predetermined gap between the outer surface of the ultrasonic horn 14D and the inner surface of the mixing vessel 24 is provided.

The inlet portion 24A is connected to the inner bottom face of the mixing vessel 24. A mixture liquid flows into the mixing vessel 24. The inlet portion 24A has an intake opening 24E on the bottom face of the mixing vessel 24. The intake opening 24E has an opening width W. The inner diameter of the intake opening 24E of the inlet portion 24A is smaller than the outer diameter of the ultrasonic horn 14D so that the opening area of the intake opening 24E portion is smaller than the irradiating zone of the ultrasonic horn 14D. A distance X between the bottom face 14E of the ultrasonic horn 14D and the inner bottom face 24C of the mixing vessel 24 is smaller than the opening width W of the intake opening 24E. The distance X is smaller than a distance Y between the outer side face 14G of the ultrasonic horn 14D and the inner side face 24D of the mixing vessel 24. The mixture liquid that flows into the mixing vessel 24 from the inlet portion 24A flows approximately vertically upward toward the center of the bottom face of the ultrasonic horn 14D until it is deflected into approximately horizontal and radial directions by hitting the bottom face 14E of the ultrasonic horn 14D. The mixture liquid flows radially outward along the flow passage defined between the bottom face of the mixing vessel 24 and the ultrasonic horn 14D.

According to the above discussed configuration, all of the mixture liquid supplied from the intake port of the inlet portion 24A flows along the flow passage formed between the bottom face of the mixing vessel 24 and the ultrasonic horn 14D. Thereby, all of the mixture liquid travels in the vicinity of the bottom face 14E of the ultrasonic horn 14D. Consequently, powder in the mixture liquid is efficiently dissipated uniformly in the mixture liquid through the ultrasonic cavitation generated by the bottom face 14E, which is the vibrating surface (the irradiating surface) of the ultrasonic horn 14D.

When the radially flowing mixture liquid approaches the inner surface of the mixing vessel 24, the flow collides with the inner surface and is deflected upward. As a result, the mixture liquid rises along the flow path between the inner surface of the mixing container 24 and the outer surface of the ultrasonic horn 14D, and is discharged from the outlet portion 24B.

On the other hand, the cooling liquid injected into the cooling vessel 26 from the inlet portion 26A flows along the annular flow passage defined between the outer surface of the mixing vessel 24 and the inner surface of the cooling vessel 26, and is discharged from the outlet portion 26B disposed on the opposite side. Namely, the mixture liquid is cooled via heat exchange between the mixture liquid flowing inside the mixing vessel 24 and the cooling liquid flowing inside the cooling vessel 26 through the side wall of the mixing vessel 24.

Figure 4:
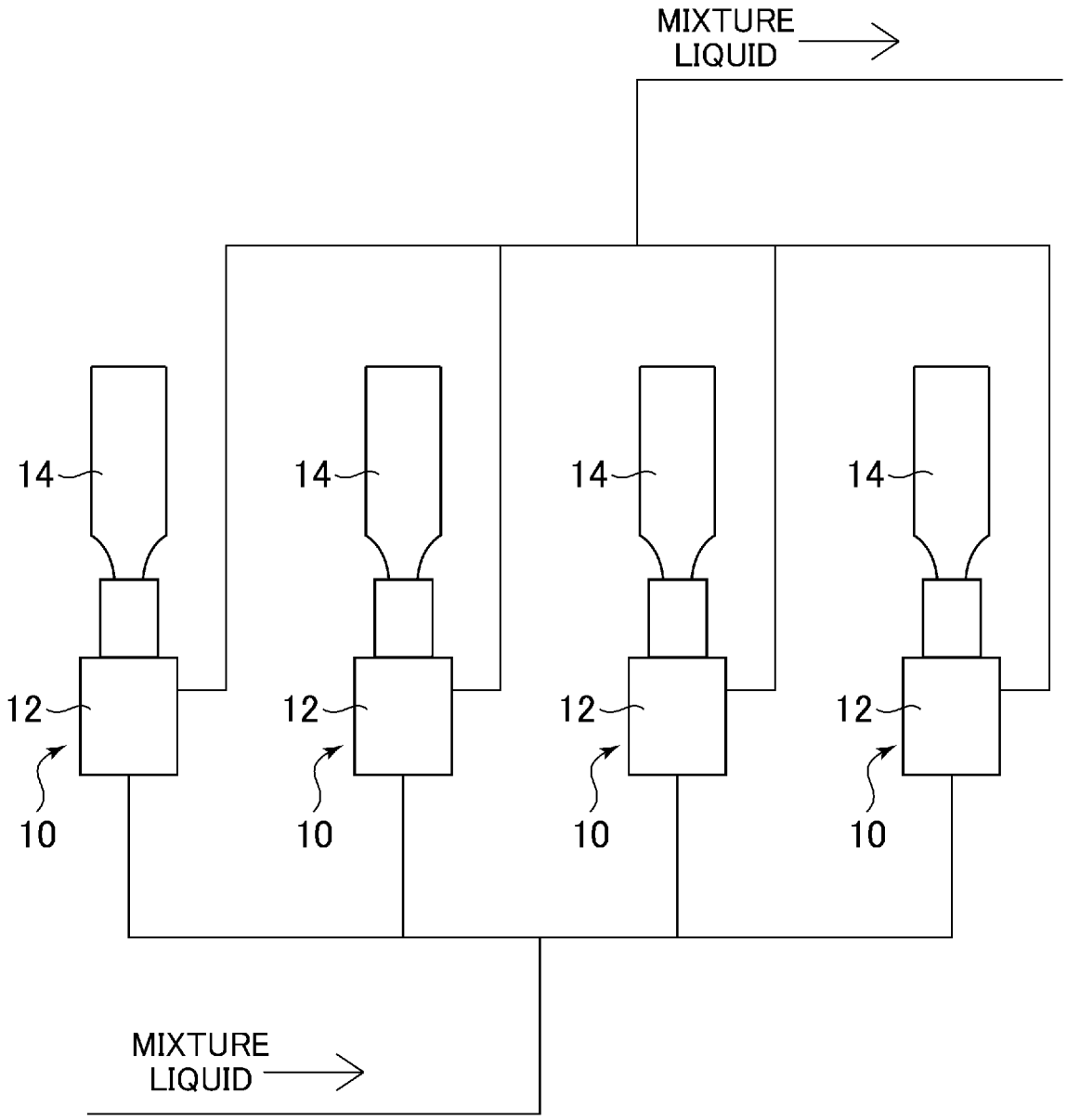
FIG. 4 is a block diagram illustrating the configuration when ultrasonic homogenizers are applied as a unit.

FIG. 4 is a block diagram illustrating the configuration when a plurality of ultrasonic homogenizers 10 are applied as a unit. As illustrated in the embodiment shown in FIG. 4, four ultrasonic homogenizers 10 are connected in parallel. Namely, the mixture liquid is delivered to each of the holders 12 of the ultrasonic homogenizer 10, respectively, and the mixture liquid discharged from each of the holders 12 are mixed together again.

As described above, according to the configuration of the ultrasonic homogenizer of the present embodiment, all of the mixture liquid injected into the holder travels in the vicinity of the vibrating surface of the ultrasonic horn so that the ultrasonic cavitation is efficiently generated in the mixture liquid and the powder in the mixing liquid is efficiently and uniformly dispersed.

Figure 5:
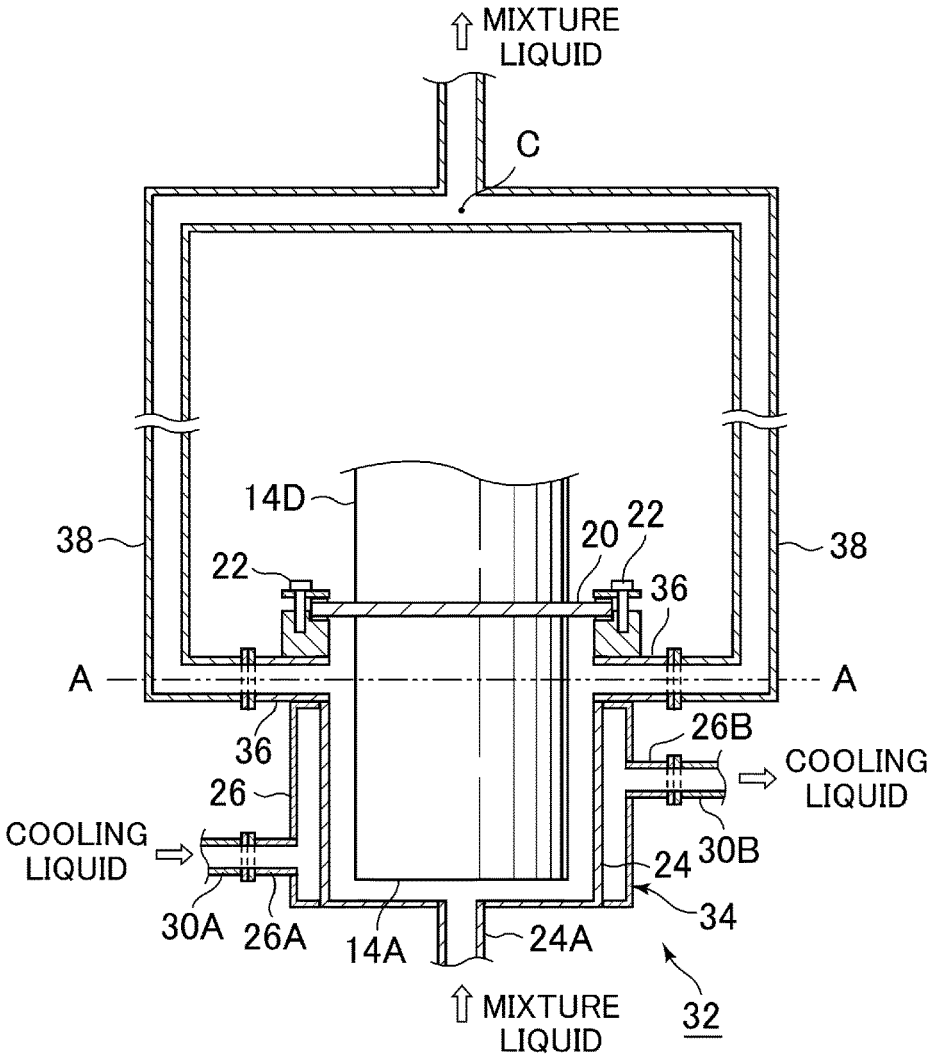
FIG. 5 is a partly enlarged cross-sectional side view schematically illustrating an arrangement of outlet portions of the ultrasonic homogenizer of an alternative embodiment and mixture liquid ejection tubes.
Figure 6:
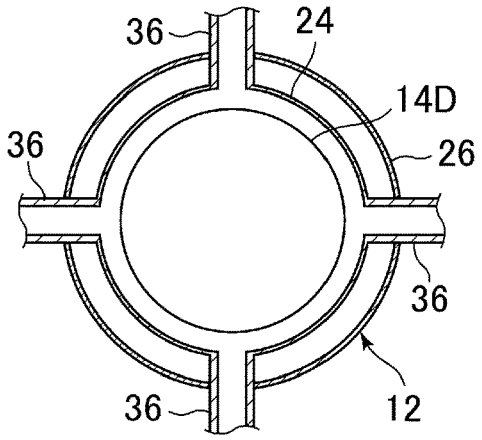
FIG. 6 is a cross-sectional view along the A-A segment of FIG. 5.

With reference to FIGS. 5 and 6, an alternative embodiment of the ultrasonic homogenizer of the present invention is explained. FIG. 5 is a partly enlarged cross-sectional side view schematically illustrating an arrangement of outlet portions of the ultrasonic homogenizer of the alternative embodiment and mixture liquid ejection tubes. FIG. 6 is a cross-sectional view along A-A segment of FIG. 5 which illustrates an arrangement of the outlet portions of the alternative embodiment. Note that the same components as in the previous embodiment are indicated by the same reference numerals; therefore, their description have been omitted.

As for the ultrasonic homogenizer of the foregoing embodiment, only one outlet portion 24B is provided at the upper peripheral portion of the mixing vessel 24. However, for the holder 34 of an ultrasonic homogenizer 32 of the alternative embodiment, a plurality of outlet portions (ejection ports) 36 is provided along the periphery. Each of the outlet portions 36 is connected with a mixture liquid ejection tube 38 and each of the mixture liquid ejection tubes 38 is joined at a downstream portion C. Note that the join position C in FIG. 5 is only schematic and the join point can be positioned anywhere.

The plurality of outlet portions 36 is arranged at the same height as the upper peripheral portion of the mixing vessel 24, and for example, at the same interval around the cylindrical axis of the mixing vessel 24 (rotational symmetry). In FIG. 6, four outlet portions 36 are radially provided. Note that the number of the outlet portions 36 is not limited to four, it can also be three, six or any other number. Furthermore, the outlet portion 26B for the cooling liquid provided on the cooling vessel 26 can be arranged at a position opposite to the inlet portion 26A where it does not interfere with the outlet portions 36. In FIG. 5, although the outlet portion 26B is positioned below the outlet portions 36, it can also be positioned at the same height in between the outlet portions 36.

As described above, the same effect obtained from the previous embodiment can also be obtained by the configuration of the alternative embodiment. Moreover, in the alternative embodiment, the dispersion effect is enhanced because the flow inside the mixing vessel becomes more uniform throughout the periphery of the mixing vessel.

Note that in a preferred embodiment, the amplitude, frequency and waveform of the ultrasonic vibration generated by the ultrasonic homogenizer are adjustable. Further, although the plurality of ultrasonic homogenizers in the present embodiments are connected in parallel as a unit, the plurality of ultrasonic homogenizers can also be connected in series as a unit. Furthermore, although a cooling liquid is adopted as the cooling medium in the present embodiments, gas may also be adopted as the cooling medium.

Although the embodiment of the present invention has been described herein with reference to the accompanying drawings, obviously many modifications and changes may be made by those skilled in this art without departing from the scope of the invention.

The present disclosure relates to subject matter contained in Japanese Patent Applications No. 2019-214384 (filed on Nov. 27, 2019) and No. 2020-132667 (filed on Aug. 4, 2020), which are expressly incorporated herein, by reference, in their entirety.

The invention claimed is:

1. An ultrasonic homogenizer, comprising:

an ultrasonic transducer;

an ultrasonic horn having a top face, a bottom face opposite to the top face, and an outer side face provided between and connected to the top face and the bottom face, the top face being connected to the ultrasonic transducer, the bottom face being configured to irradiate an ultrasonic wave generated by the ultrasonic transducer;

a holder having an inner bottom face and an inner side face connected to the inner bottom face, the ultrasonic horn being provided in the holder such that the bottom face of the ultrasonic horn faces the inner bottom face of the holder and such that the inner side face of the holder surrounds and faces the outer side face of the ultrasonic horn;

an intake port that is connected to the inner bottom face of the holder and through which a mixture liquid flows into the holder, the intake port having an intake opening on the bottom face of the holder, the intake opening having an opening width;

an ejection port that is provided on the holder above the intake port and through which the mixture liquid is discharged from the holder;

an opening area of the intake opening being smaller than an irradiating area of the bottom face of the ultrasonic horn; and a distance between the bottom face of the ultrasonic horn and the inner bottom face of the holder being smaller than the opening width of the intake opening.

2. The ultrasonic homogenizer according to claim 1, wherein a flange is attached to a center of vibration of the ultrasonic horn and the flange is attached to the holder.

3. The ultrasonic homogenizer according to claim 1, wherein a jacket passage for a cooling medium is provided around the holder and the ejection port is provided on an upper portion of the jacket.

4. The ultrasonic homogenizer according to claim 1, wherein a plurality of said ejection ports are provided around a periphery of the holder and downstream sections of ejection tubes connected to each of the ejection ports are joined together.

5. The ultrasonic homogenizer according to claim 2, wherein a jacket passage for a cooling medium is provided around the holder and the ejection port is provided on an upper portion of the jacket.

6. The ultrasonic homogenizer according to claim 2, wherein a plurality of said ejection ports are provided around a periphery of the holder and downstream sections of ejection tubes connected to each of the ejection ports are joined together.

7. The ultrasonic homogenizer according to claim 1, wherein the intake opening has a circular shape and the distance between the bottom face of the ultrasonic horn and the inner bottom face of the holder is smaller than a diameter of the intake opening.

8. The ultrasonic homogenizer according to claim 1, wherein the distance between the bottom face of the ultrasonic horn and the inner bottom face of the holder is smaller than a distance between the outer side face of the ultrasonic horn and the inner side face of the holder.

* * * * *